United States Patent [19]

Rogers, Jr.

[11] Patent Number: 4,740,031

[45] Date of Patent: Apr. 26, 1988

[54] MECHANISM FOR A RECLINING CHAIR OR SOFA MODULE

[75] Inventor: Walter C. Rogers, Jr., Denton, N.C.

[73] Assignee: Parma Corporation, Denton, N.C.

[21] Appl. No.: 904,242

[22] Filed: Sep. 5, 1986

[51] Int. Cl.[4] ..... A47C 1/02

[52] U.S. Cl. ..... 297/85; 297/232; 297/322

[58] Field of Search ..... 297/85, 84, 83, 322, 297/316

[56] References Cited

U.S. PATENT DOCUMENTS

| | | | |
|---|---|---|---|
| 3,743,349 | 7/1973 | Crum et al. | 297/85 |
| 3,849,052 | 8/1958 | Schliephacke | 297/85 |
| 4,071,275 | 1/1978 | Rogers | 297/85 |
| 4,108,491 | 8/1978 | Rogers | 297/85 |
| 4,350,387 | 9/1982 | Rogers | 297/85 |
| 4,531,778 | 7/1985 | Rogers | 297/85 |
| 4,570,995 | 2/1986 | Rogers | 297/85 |

*Primary Examiner*—Francis K. Zugel
*Attorney, Agent, or Firm*—William E. Mouzavires

[57] ABSTRACT

An improved mechanism for a reclining chair or sofa module allows the backrest to be placed virtually against a nearby wall in a room without offering any obstruction when the chair is placed into reclining position. The mechanism may incorporate a backrest of an average of conventional length and, in the preferred embodiment, the mechanism is driven to TV position by the weight of the chair occupant upon release of a locking means which holds the mechanism in the normal or closed position. Preferably, a manually-operable handle positioned on one side of the chair in accordance with conventional practice, is utilized to release the lock mechanism. Once in TV position, the chair may be moved to advanced reclining positions by the occupant exerting pressure on the backrest during which time the backrest will not strike the adjacent wall.

16 Claims, 5 Drawing Sheets

MECHANISM FOR A RECLINING CHAIR OR SOFA MODULE

RELATED APPLICATION

Portions of the disclosure of the present application are similar to portions of the disclosure of my copending U.S. application Ser. No. 06/878,702, filed June 26, 1986 and entitled "Rocker Recliner".

BACKGROUND OF THE INVENTION

Many of today's sofas consist of modular units abutted against each other into the desired arrangement. Additionally, one of the modules may, for example, include a sofa bed and another, a reclining mechanism allowing that module to be placed into TV or advanced reclining positions with a footrest extended. Although sofas are often placed against a wall in a room, it has been necessary in conventional modular sofas including reclining mechanisms, to place the backrest at least about three inches from the wall in order to ensure that the backrest does not strike the wall when the module is placed into reclining position. Conventional wall-avoiding mechanisms for reclining chairs including average-size backrests require about a three inch clearance as stated, and in order to reduce the wall clearance, it has been necessary shorten the length of the backrest. However, the latter detracts from back support and styling capabilities.

An example of the prior art appears in my prior U.S. Pat. No. 4,350,387, issued Sept. 21, 1986 which discloses a "gravity-loaded" reclining chain which may be placed adjacent to or about three inches from a nearby wall without striking the wall upon reclining movement. Although this mechanism has been commercially accepted, the advent of modular sofas described above, has created today a need for a reclining chair mechanism that may incorporate a backrest of average length and yet may be placed virtually against or in contact with an adjacent wall and will be operable to reclining positions without interference from the wall. In the present context, an average length of backrest is about twenty-five inches from the top of the seat plane at its rear to the top of the backrest. The present invention may therefore be viewed as an improvement over the mechanism disclosed in my prior patent U.S. Pat. No. 4,350,387.

OBJECTS OF THE INVENTION

It is therefore an object of the present invention to provide an improved mechanism for a reclining chair or sofa module or the like that may be placed virtually against the wall and moved into reclining position without interference from the wall. Included herein is such a mechanism that may be incorporated in a reclining chair or sofa module or the like without sacrificing backrest support or styling capabilities and without requiring the length of the backrest to be reduced.

Another object of the present invention is to provide a reclining chair or sofa module incorporating the aforementioned mechanism. Included herein is such a reclining chair or sofa module that may incorporate an average-size backrest for providing desired backrest support and styling.

Another object of the present invention is to provide an improved mechanism for a reclining seating unit which mechanism includes a compact arrangement of links which are efficiently operable particularly with regard to extension of a footrest linkage included therein.

SUMMARY OF INVENTION

In summary, the present invention involves improvements to a mechanism for a reclining seating unit such as a chair or a module of a sofa for example. The improvements allow the seating unit to be placed virtually against a wall without interference from the wall when the seating unit is placed into reclining position. At the same time, the improvements do not require that the length of the backrest be reduced below the average length in use today.

In one preferred embodiment, a seating unit incorporating the improved mechanism has its seat suspended from front and rear seat mounting links through a pair of front and rear suspension links, the rear one of which is pivotally mounted to the seat well below the general plane of the seat which is in contrast to conventional practice. The suspension links are interconnected by a control link located above the pivotal mounting of the rear suspension link to the seat, and the arrangement of these parts allows greater forward travel and hence greater wall-avoiding movement allowing the backrest to be placed against a wall. In addition, the footrest drive link included in the footrest linkage is provided with an arm portion extending beyond its pivotal mounting connection to the seat to provide a crank to be driven by a connecting link by the application of a tension force to the crank rather than a pushing force applied to the drive link below the pivotal mounting connection to the seat as is conventional. The connecting link is driven by a crank, in turn, driven by a draw bar link preferably from the front seat mounting link as the latter moves together with the rear seat mounting link under the force of gravity derived from the occupant's weight. The crank is pivotally mounted to the seat and the draw bar link is pivotally connected to the crank at a location below the pivotal mounting of the crank to the seat. As is conventional, a locking linkage is included to retain the mechanism in closed position against the gravity force which urges the mechanism to open or TV position; and a manually operated release is provided to release the locking linkage to allow the chair to move to TV position under the occupant's weight.

DRAWINGS

Other objects and advantages will become apparent from the following more detailed description taken in conjunction with the attached drawings in which.

DETAILED DESCRIPTION

Figure 5:
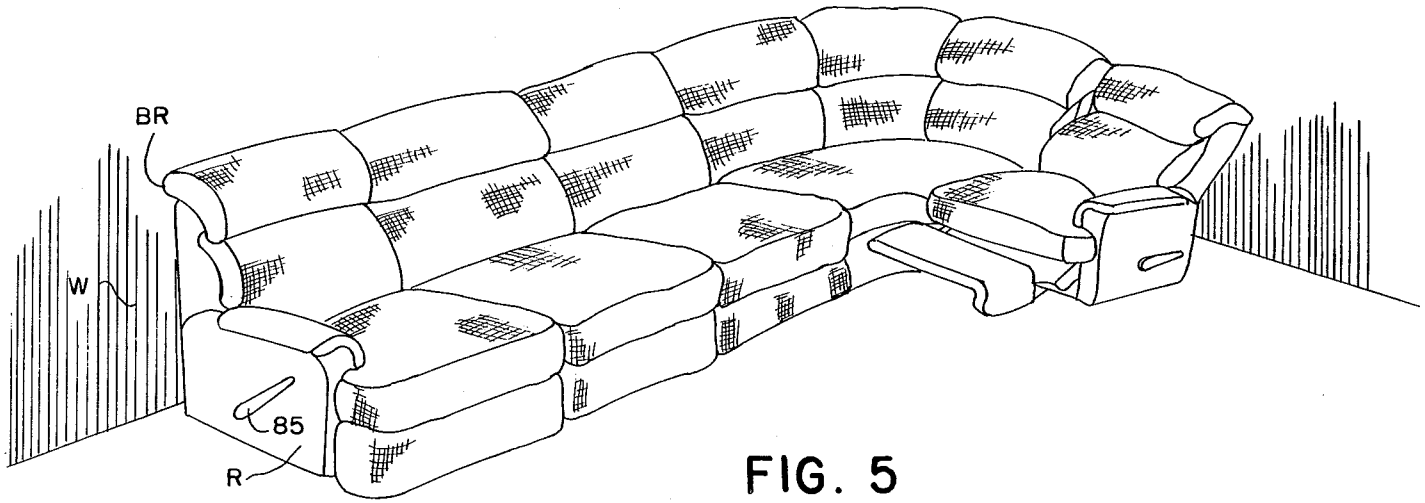
FIG. 5 is a perspective view of a sofa placed against the wall and consisting of modules including reclining chair modules embodying the invention and located at the opposite ends of the sofa and with one of the reclining chair modules shown in reclining position.

Referring now to the drawings in detail, there is shown for illustrative purposes only a reclining seating unit that forms the end module R of a sofa shown in FIG. 5; the reclining seating unit incorporating the improved mechanism of the present invention. The sofa shown in FIG. 5 is in the category of motion furniture since its several modules may be separated into various units or sub-units or may be used together as shown in FIG. 5. In the arrangement shown in FIG. 5, both end modules are reclining seating units and one unit R being shown in the closed or generally upright normal position and the other shown in TV position, that is, with the footrest extended. Note that the sofa is placed with the top of the backrest BR virtually against the wall W and that the one end module has been moved into reclining position despite the closeness of the wall W.

Figure 1:
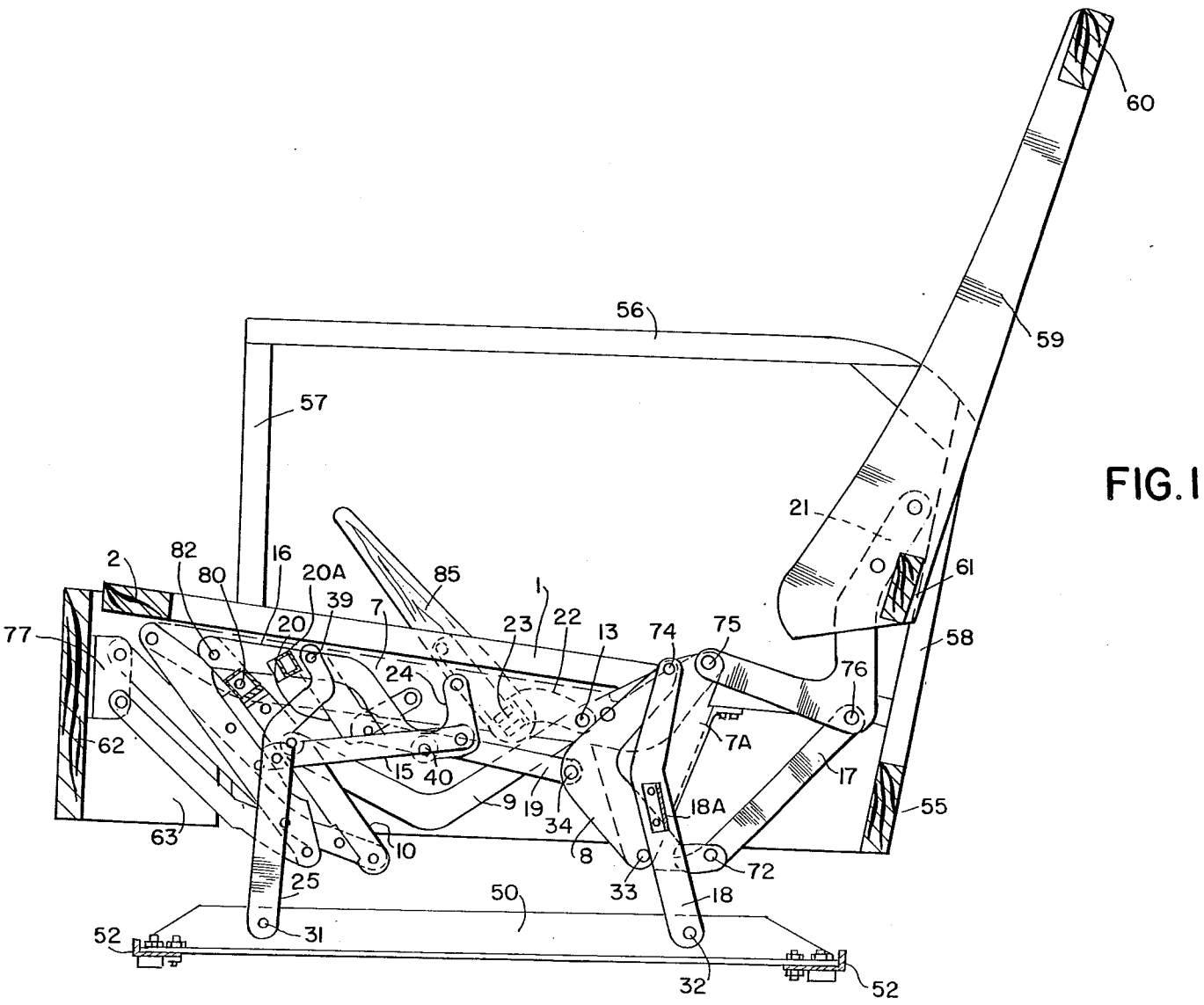
FIG. 1 is a side-elevational view of a reclining chair which may be utilized as a sofa module incorporating a preferred embodiment of the present invention and shown in the normal or closed positions and with certain portions shown in cross section.

Referring to FIG. 1, the reclining seating unit R includes a base structure including side rails 50 and end rails 52 joining the latter to form a rectangular structure. Supported on the base structure, by the improved linkage system to be described below, for movement between generally upright and reclining positions is a seat and backrest assembly whose seat frame portion includes side rails 1 and end rails 2; only one of these elements being shown in FIG. 1. The backrest frame includes side rails 59 and end rails 60, 61, while a single armrest frame includes a side rail 56 fixed on top of front and rear vertical rails 57 and 58 which are fixed to the seat frame 1.

In one preferred embodiment of the present invention, the improved linkage mechanism, with reference to one side thereof, includes front and rear seat mounting links 25 and 18, respectively, pivotally mounted by pivots 31 and 32 to the base rail 50, and by pivots 39 and 74 to front and rear suspension links 20 and 8, respectively. The latter are pivotally mounted to a seat link 7 by pivots 38 and 33 respectively. Seat link 7 is rigidly fixed to and along the underside of seat frame side rail 1 and includes a lower appendage 7A shown as a generally triangular plate which extends adjacent to the level of the base structure to provide a low pivot location for pivot 33 which mounts the suspension link 8 thereto as described above.

Figure 2:
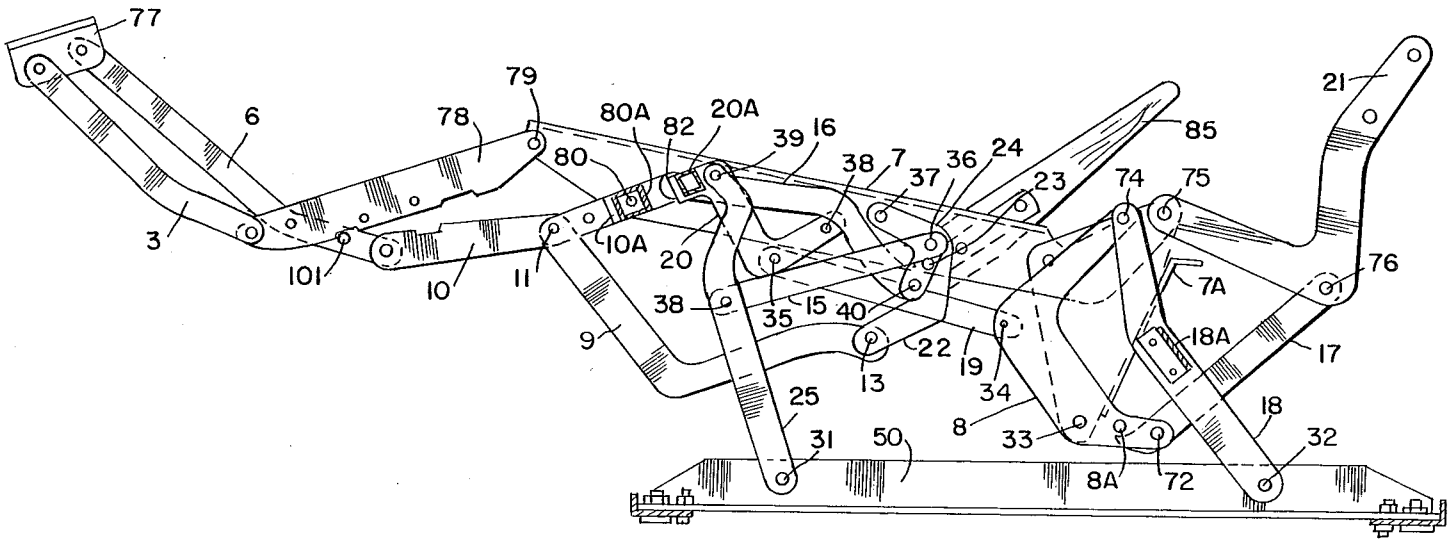
FIG. 2 is a view generally similar to FIG. 1 showing the linkage mechanism in TV position while omitting portions of the associated chair frame.
Figure 4:
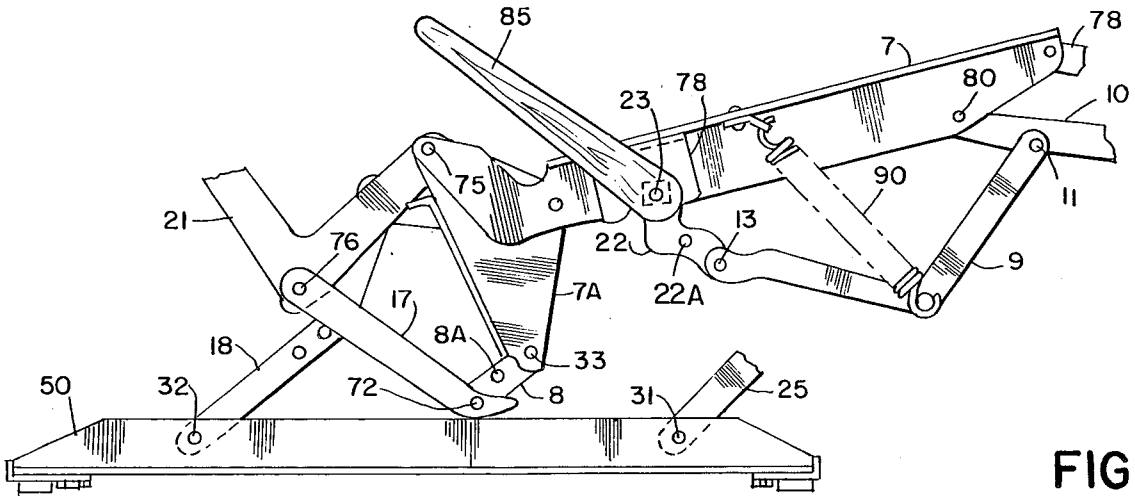
FIG. 4 is a side view of a portion of the mechanism seen from the side which is opposite that shown in FIGS. 1 through 3.

Referring to FIG. 1, it will be seen that the upper pivot 74 of the rear seat mounting link 18 is forwardly or to the left of a vertical plane extending at right angles to the base when the seat unit is in the normal generally upright position. Therefore, the occupant's weight will tend to move the mounting links 18 and 25 forwardly to recline the chair into TV position. To prevent this tendency, a lock mechanism including a link 9 is provided with its forward end pivotally connected by pivot 11 is a footrest link 10 to be further described below and its rearward end pivotally connected by pivot 13 to a release link 22 which is fixed to a manual release handle 185. The latter is mounted for pivotal movement to the seat link 7 at the side of the seating unit as is well-known for movement between the positions shown in FIGS. 1 and 2. As shown in FIG. 4, an overcenter tension spring 90 is connected to and between seat link 78 and locking link 9 to bias the handle and release mechanism in both of their positions. In the position of FIG. 1, the weight of the chair occupant will keep links 9 and 22 in the closed or locking position preventing movement of the seat mounting links forwardly to TV position. In order to move the chair into TV position, the occupant merely grasps handle 85 and moves it to the position shown in FIG. 2 to open links 9 and 22, whereupon the occupant's weight will move the links 18 and 25 forwardly relative to the base until the TV position of FIG. 2 is reached. During the latter movement, the position of links 18 and 25 is controlled by control link 19 pivoted at pivots 35 and 34 to and between suspension links 20 and 8. The aforementioned locking and release linkage 9, 22, 85 is also disclosed in my copending U.S. Application Ser. No. 06/878,702 identified above. Another form of locking and release linkage is disclosed in my prior patent U.S, Pat. No. 4,350,387 identified above.

Figure 3:
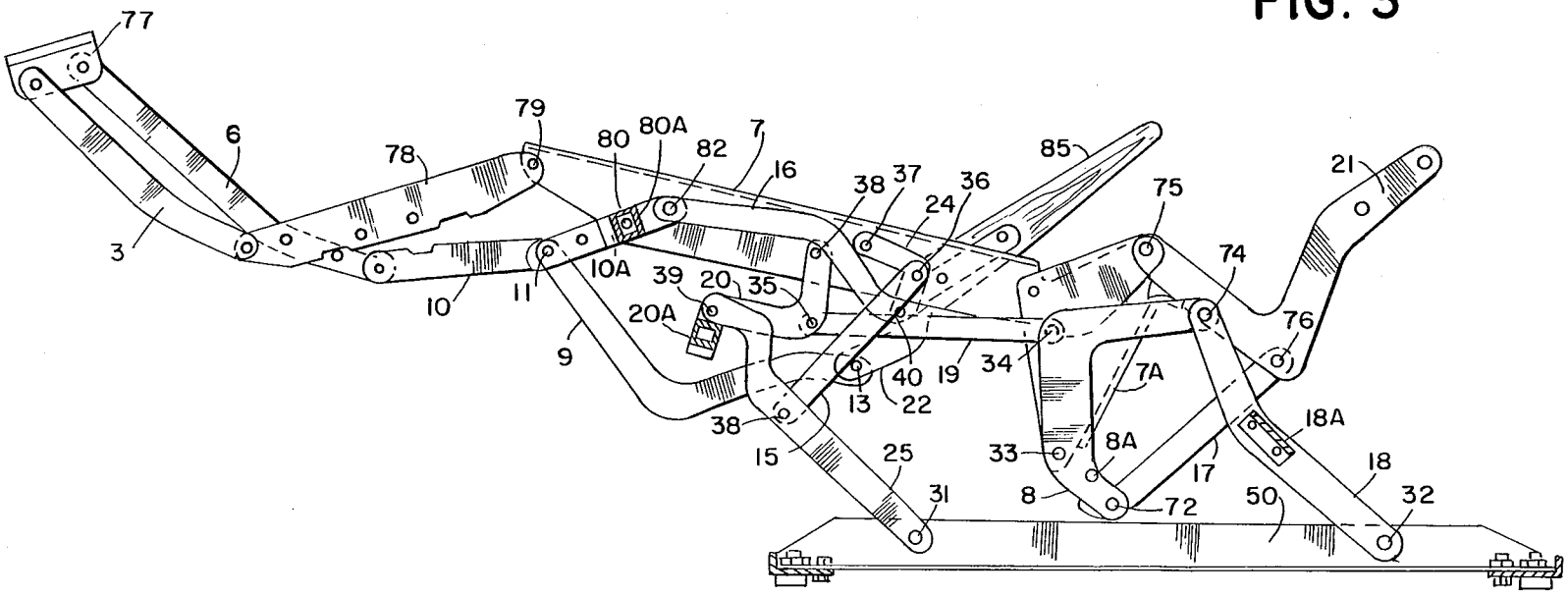
FIG. 3 is a view generally similar to FIG. 2 except that the mechanism is in the fully reclined position beyond TV position.

Referring to FIGS. 1 and 2, the footrest includes a footrest frame 62 having a bracket link 77 fixed thereto and a first pair of generally parallel links 3 and 6 pivotally connected to bracket link 77 at spaced locations. The footrest linkage additionally includes a second pair of generally parallel links 10 and 78 respectively pivoted to the first pair 3 and 6 with link 78 also being pivoted to link 6. Link 78 is pivoted by pivot 79 to the first portion of seat link 7 while link 10 is pivoted by pivot 80 to seat link 7. As described thus far, the footrest linkage is conventional and also shown in my prior copending U.S. application identified above. However, in accordance with a feature of the present invention, the present footrest linkage differs from the former in that a crank portion 10A is provided on link 10 to extend beyond its pivot at 80 to seat link 7 for the purpose of enabling the footrest to be driven by application of a tension force to link 10 operating on crank portion 10A to drive link 10 clockwise about pivot 80 to drive the footrest to extended TV position. This drive is derived from the front seat mounting link 25 through a train including a draw bar link 15, a drive crank 24 and a connecting link 16. Drive crank 24 is L-shaped and pivotally mounted at the end of one leg by pivot 37 to seat link 7 with its other leg pivotally connected by pivot 40 to the rear end of connecting link 16 as best shown in FIGS. 2 and 3. As shown in FIG. 3, the forward end of connecting link 16 is pivotally connected to the extremity of crank portion 10A of footrest link 10. One end of draw bar link 15 is pivotally connected by pivot 38 to an intermediate portion of front mounting link 25 while the opposite end is pivotally connected by pivot 36 to drive crank 24 at the bite portion of the latter as best shown in FIG. 3. In contrast to the drive crank 82 of the mechanism disclosed in my prior U.S. Pat. No. 4,350,387, the drive crank 24 in the presently described mechanism of this invention is inverted with the pivotal connection at 36 of the draw bar link 15 being located below the pivotal mounting at 37 of the drive crank 24 to seat link 7. This allows actuation of the footrest link 10 by a tension or pulling-type force on crank 10A, rather than a compression or pushing force to the link 10 below its pivotal mounting at 80, while also allowing a more compact arrangement of the links. In operation of the footrest from closed position of FIG. 1 to TV position of FIG. 2, the draw bar 15 will rotate drive crank 24 in a counterclockwise direction (as viewed in FIGS. 1 and 2) about pivot 37 which, in turn, will pull connecting link 16 rearwardly t in turn rotate footrest link 10 clockwise about pivot 80 to extend the footrest until the stop 101 on footrest link 6 engages footrest link 78 to determine the TV position of the mechanism.

The backrest frame 59 is pivotally mounted to the seat frame by means of a backrest link 21 having a first leg fixed to the backrest side rail 59 of the backrest and a second leg pivotally mounted by pivot 75 to the seat link portion 7A. In addition, the backrest linkage includes a second link 17 having one end pivotally connected by pivot 76 to link 21 and an opposite end pivotally connected by pivot 72 to a lower portion of the suspension link 8 below the pivotal mounting at 33 of the suspension link 8 to seat link portion 7A. The lower extremity of backrest link 17 beyond the pivot 72 is formed with a slightly hooked shape to engage a stop 8A to maintain the backrest in a fixed predetermined position relative to the seat when the seating unit is in the normal position and during movement to TV position. However, once the seating unit is in TV position shown in FIG. 2, the chair occupant may exert pressure on the backrest to move the backrest relative to the seat to place the seating unit into a number of advanced reclining positions; and fully reclined position being shown in FIG. 3. Comparing the positions of the links in FIGS. 1 and 2, it will be seen that during advanced reclining movement, rear suspension link 8 will pivot clockwise about pivot 33 drawing with it rearwardly the control link 19 which, in turn, will pivot front suspension 20 counterclockwise about its pivot 38 to thus position the seat together with the rear suspension link 8 into the desired advanced reclining position relative to the base and backrest.

In order to return the seating unit to TV position from any advanced reclining position, the chair occupant need only remove pressure from the backrest and the occupant's weight will automatically return the mechanism to the TV position. To return the mechanism from TV to the closed or generally upright position shown in FIG. 1, the chair occupant need only return the footrest to retracted position by application of leg pressure on the footrest 62. Once in the closed position of FIG. 1, the lock and release links 9 and 22 will prevent movement of the mechanism to TV position which may be achieved only by movement of the handle 85 from the position of FIG. 1 to the position of FIG. 2.

The linkage system on the side opposite that shown and described above is actuated in unison with the latter by means of a torque tube 80A fixed to and between the crank portions 10A on opposite sides of the seating unit and a torque tube 20 affixed to and between drive cranks 20 on opposite sides of the seating unit. It should be understood that lock and release links 9 and 22 are not required on the opposite linkage system (not shown), and there is a handle 85 only on the side of the seating unit as shown. The linkage systems on opposite sides of the seating unit are stabilized by torque bars 20A and 80A described above as well as by a stabilizing bar 18A fixed to and between the rear seat mounting links 18 on opposite sides of the seating unit.

It will therefore be seen that the present invention provides an improved mechanism for a three-way reclining seating unit allowing a compact arrangement of linkages which will efficiently operate with greater forward travel to place the seating unit into various desired reclining positions and without striking a nearby wall even if the backrest is placed virtually against the wall.

What is claimed is:

1. A reclining seating unit comprising in combination, a base, a seat, a backrest, a linkage system mounting the seat and backrest relative to the base and including front and rear seat mounting links pivotally mounted on the base at locations spaced along a forward-rearward direction of the seating unit, front and rear suspension links pivotally mounted to the seat and pivotally connected to the front and rear seat mounting links respectively, a footrest, a footrest linkage mounting the footrest relative to the seat for movement between a retracted position adjacent the seat and an extended position projected forwardly from the seat, said footrest linkage including a footrest mounting link pivotally mounted to the seat and including a crank portion offset beyond the pivotal connection of the footrest mounting link to the seat, footrest actuating linkage including a drive crank pivotally mounted to the seat, and a connecting link interconnecting the drive crank and the crank portion of the footrest mounting link such that when the drive crank is driven in one rotative direction, the footrest mounting link will be driven in an opposite relative direction to extend the footrest linkage, and wherein the drive crank when driven exerts a pulling force on the connecting link to drive said crank portion of the footrest mounting link.

2. The seating unit defined in claim 1 wherein said footrest actuating linkage includes a draw bar link pivotally connected to the drive crank below the pivotal connection of the drive crank to the seat for actuating the drive crank.

3. The seating unit defined in claim 2 wherein said draw bar link is pivotally connected to the front seat mounting link to be driven thereby.

4. The seating unit defined in claim 3 further including a control link interconnecting said front and rear suspension links, and wherein said rear suspension link is pivotally connected to said seat at a location below the pivotal connection of said control link to said rear suspension link.

5. The seating unit defined in claim 1 further including a control link interconnecting said front and rear suspension links, and wherein said rear suspension link is pivotally connected to said seat at a location below the pivotal connection of said control link to said rear suspension link.

6. The footrest defined in claim 1 further including backrest linkage including a first backrest link fixed to the backrest and pivotally mounted to the seat, a second backrest link pivotally connected to the first backrest link and the rear suspension link and wherein once the footrest is in extended position, the front and rear suspension links are movable in opposite rotative directions to move the backrest relative to the seat and the seat relative to the base.

7. The seating unit defined in claim 4 further including backrest linkage including a first backrest link fixed to the backrest and pivotally mounted to the seat, a second backrest link pivotally connected to the first backrest link and the rear suspension link and wherein once the footrest is in extended position, the front and rear suspension links are movable in opposite rotative directions to move the backrest relative to the seat and the seat relative to the base.

8. The seating unit defined in claim 6 including stop means on said rear suspension link and said second backrest link for preventing movement of the backrest relative to the seat unless the footrest is in extended position.

9. The seating unit defined in claim 7 including stop means on said rear suspension link and said second backrest link for preventing movement of the backrest relative to the seat unless the footrest is in extended position.

10. A linkage mechanism for use in a reclining seating unit having a seat and a backrest, the mechanism comprising in combination a base link, front and rear seat mounting links pivotally mounted to the base link at locations spaced along the base link, a seat link adapted to be fixed along a seat, front and rear suspension links pivotally mounted to the seat link at spaced locations along the seat link, the front and rear suspension links being pivotally connected to upper portions of the front and rear seat mounting links respectively, the seat link having a depending portion projecting downwardly at a rear portion thereof to a region adjacent the base link, said rear suspension link being pivotally mounted to said depending portion of said seat link, a control link pivotally connected at one end portion thereof to an intermediate portion of the front suspension link at a location below the pivotal connection of the front suspension link to the seat link, said control link being connected at an opposite end portion thereof to said rear suspension link above the pivotal connection of the rear suspension link to said depending portion of said seat link and below the pivotal connection of the rear suspension link to the rear seat mounting link, a first backrest link adapted to be fixed to a backrest and being pivotally mounted to the seat link at a rear portion thereof, a second backrest link having one end portion pivotally connected to the first backrest link and having an opposite end portion pivotally connected to a lower portion of said rear suspension link, a footrest linkage pivotally mounted to said seat link forwardly of the pivotal connection of said front suspension link to said seat link for movement between extended and retracted positions, drive means for driving said footrest linkage between extended and retracted positions, stop means for preventing relative movement between said backrest links, said suspension links and the seat link when the footrest linkage is in retracted position and during movement of said footrest to extended position, said backrest links being movable relative to the seat link once said footrest linkage is in extended position to drive the rear suspension link in one rotative direction causing the control link to move rearwardly to drive the front suspension link in a second rotative direction opposite said first rotative direction.

11. The linkage mechanism defined in claim 10 wherein said footrest linkage includes a mounting link pivotally mounted to the seat link and having a crank portion extending beyond the pivotal mounting of said footrest mounting link to the seat link and wherein said drive means for driving said footrest linkage includes a drive crank pivotally mounted to the seat link, a connecting link pivotally connected to the drive crank below the pivotal mounting of the drive crank to the seat link, said connecting link being pivotally connected to said crank portion of said footrest mounting link, and means for rotating said drive crank in one direction to drive said footrest mounting link in an opposite rotative direction to extend the footrest linkage through means of said connecting link, said drive crank exerting a pulling force on said connecting link when said drive crank is rotated in said one rotative direction thereof.

12. The linkage mechanism defined in claim 11 wherein sid means for rotating said drive crank includes a draw bar link pivotally connected to said drive crank below the pivotal mounting of said drive crank to said seat link.

13. The linkage mechanism defined in claim 12 wherein said means for rotating said drive crank further ncludes said front seat mounting link, said draw bar link being pivotally connected to an intermediate portion of said front seat mounting link.

14. A mechanism for a reclining seating unit having a seat and a backrest, the mechanism including in combination; a base link, front and rear seat mounting links pivotally mounted to the base link at spaced locations along the latter, a seat link located above the base link and extending in the same general directin thereof, front and rear suspension links pivotally mounted to said seat link at spaced locations along the seat link while also being pivotally connected to said front and rear seat mounting links to suspend the seat link from said front and rear seat mounting links, a footrest linkage pivotally mounted to the seat link for movement between extended and retracted positions and including a footrest mounting link pivotally mounted to the seat link and having a crank portion extending beyond the pivotal mounting of the footrest mounting link to the seat link, drive means for driving said footrest mounting link to extend and retract the footrest linkage, said drive means including a drive crank pivotally mounted to the seat link, a connecting link pivotally connected to the crank portion of said footrest mounting link and pivotally connected to the drive crank below the pivotal mounting of the drive crank to the seat link for rotating the footrest mounting link in one direction when the drive crank is rotated in an opposite rotative direction to exert a pulling force on the connecting link and means for rotating said drive crank to extend the footrest linkage.

15. The linkage mechanism defined in claim 14 wherein said means for rotating said drive crank includes a draw bar link connected at one end portion to the drive crank at a location below the pivotal mounting of the drive crank to the seat link, said draw bar link being connected at an opposite end to the front seat mounting link to be driven thereby.

16. A linkage mechanism for use in a reclining seating unit having a seat and a backrest, the mechanism comprising in combination a base link, front and rear seat mounting links pivotally mounted to the base link at locations spaced along the base link, a seat link adapted to be fixed along a seat, front and rear suspension links pivotally mounted to the seat link at spaced locations along the seat link, the front and rear suspension links being pivotally connected to the front and rear seat mounting links respectively, the seat link having a depending portion projecting downwardly at a rear portion thereof to a region adjacent the base link, said rear suspension link being pivotally mounted to said depending portion of said seat link, a control link pivotally connected at one end portion thereof to an intermediate portion of the front suspension link at a location below the pivotal connection of the front suspension link to the seat link, said control link being connected to an opposite end portion thereof to said rear suspension link above the pivotal connection of the rear suspension link to said depending portion of said seat link and below the pivotal connection of the rear suspension link to the rear seat mounting link, a first backrest link adapted to be fixed to a backrest and being pivotally mounted to the seat link, a second backrest link having one end portion pivotally connected to the first backrest link and having an opposite end portion pivotally connected to said rar suspension link, a footrest linkage pivotally mounted to said seat link for movement between extended and retracted positions, drive means for driving said footrest linkage between extended and retracted positions, means for preventing relative movement between said backrest links, said suspension links and the seat link when the footrest linkage is in retracted position and during movement of said footrest to extended position, said backrest links being movable relative to the seat link once said footrest linkage is in extended position to drive the rear suspension link in one rotative direction causing the control link to move rearwardly to drive the front suspension link in a second rotative direction opposite said first rotative direction.

* * * * *

UNITED STATES PATENT AND TRADEMARK OFFICE

CERTIFICATE OF CORRECTION

PATENT NO. : 4,740,031

DATED : April 26, 1988

INVENTOR(S) : Walter C. Rogers, Jr.

It is certified that error appears in the above-identified patent and that said Letters Patent is hereby corrected as shown below:

Col. 1, line 32, before "which", delete "chain" and insert -- chair --.

Col. 3, line 57, after "11", delete "is" and insert -- to --.

Col. 4, line 65, before "in", delete "t" and insert -- to --.

Col. 5, line 20, before fully, delete "and" and insert -- the --.

Col. 7, line 67, before "means", delete "sid" and insert -- said --.

Col. 8, line 5, before "said", delete "ncludes" and insert -- includes --;

line 13, before "thereof," delete "directin" and insert -- direction --;

line 59, after "connected", delete " to" and insert -- at --;

line 68, after "said", delete "rar" and insert -- rear --.

Signed and Sealed this

Twenty-eighth Day of May, 1991

*Attest:*

HARRY F. MANBECK, JR.

*Attesting Officer*

*Commissioner of Patents and Trademarks*